US010017954B2

(12) United States Patent
Pereira et al.

(10) Patent No.: US 10,017,954 B2
(45) **Date of Patent: *Jul. 10, 2018**

(54) VARIABLE HEIGHT TELESCOPING LATTICE TOWER

(71) Applicant: US Tower Corp., Lincoln, KS (US)

(72) Inventors: Kenneth Pereira, Woodlake, CA (US); Karen Eredia, Woodlake, CA (US); Stacey A. Perez, Woodlake, CA (US)

(73) Assignee: US Tower Corp., Lincoln, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/382,348

(22) Filed: Dec. 16, 2016

(65) Prior Publication Data

US 2017/0096830 A1 Apr. 6, 2017

Related U.S. Application Data

(63) Continuation of application No. 15/148,173, filed on May 6, 2016, now Pat. No. 9,523,212, which is a continuation of application No. 14/675,242, filed on Mar. 31, 2015, now Pat. No. 9,371,662.

(51) Int. Cl.

| | |
|---|---|
| ***E04H 12/18*** | (2006.01) |
| ***E04H 12/10*** | (2006.01) |
| ***E04H 12/34*** | (2006.01) |
| ***E04B 1/343*** | (2006.01) |
| ***E04C 3/00*** | (2006.01) |
| ***E04B 1/19*** | (2006.01) |
| *E04H 12/00* | (2006.01) |

(52) U.S. Cl.

CPC ..... *E04H 12/182* (2013.01); *E04B 1/19* (2013.01); *E04B 1/34305* (2013.01); *E04C 3/005* (2013.01); *E04H 12/10* (2013.01); *E04H 12/185* (2013.01); *E04H 12/187* (2013.01); *E04H 12/34* (2013.01); *E04H 2012/006* (2013.01)

(58) Field of Classification Search

CPC ..... E04H 12/18; E04H 12/182; E04H 12/10; E04H 12/00; E04H 12/34; E04H 12/185; E04C 3/30; E04C 3/005; E04B 1/18; E04B 1/1903; E04B 1/19; E04B 1/34305

See application file for complete search history.

(56) References Cited

U.S. PATENT DOCUMENTS 1,382,199 A * 6/1921 Lachman ..... E04H 12/10 52/634

1,645,060 A * 10/1927 Kraft ..... E04C 3/09 52/634

(Continued)

*Primary Examiner* — Adriana Figueroa

*Assistant Examiner* — Jessie T Fonseca

(74) *Attorney, Agent, or Firm* — Glass & Associates; Kenneth Glass; Kenneth D'Alessandro

(57) ABSTRACT

A variable height telescoping tower includes a base section and a second lower most section nested within the base section and extendable from within the base section. The second lower most section includes a plurality of vertically spaced lock apertures disposed thereon. A lock member is attached to the base section, and includes an engaging portion movable between a disengaged position at which the engaging portion rests outside of the lock apertures and an engaged position at which the engaging portion is engaged within one of the lock apertures of the second lower most section.

10 Claims, 9 Drawing Sheets

50
52
52
40
46
46
46

(56) References Cited

U.S. PATENT DOCUMENTS 2,576,389 A * 11/1951 Craighead ..... E04H 12/182 182/69.4
2,819,803 A * 1/1958 Obenchain ..... B66C 23/36 182/2.11
3,047,107 A * 7/1962 Parmenter ..... E04H 12/182 52/121
3,284,972 A * 11/1966 Werner ..... E04H 12/182 52/118
3,373,473 A * 3/1968 Keslin ..... E04H 12/182 29/897.33
3,564,789 A * 2/1971 Vyvyan et al. ..... E04C 3/005 52/108
4,166,542 A * 9/1979 Bryan, Jr. ..... B66C 23/703 212/231
4,196,814 A * 4/1980 Reich ..... B66C 23/30 212/204
4,590,720 A * 5/1986 Reed ..... E04H 12/182 254/336
4,637,192 A * 1/1987 Brown ..... E04H 12/18 428/12
5,101,215 A * 3/1992 Creaser, Jr. ..... E04H 12/182 343/883
5,109,643 A * 5/1992 Speers ..... E04B 7/00 52/220.3
7,574,832 B1 * 8/2009 Lieberman ..... E04H 12/10 212/350
2001/0025727 A1 * 10/2001 Byrt ..... E21B 15/02 175/7
2006/0272265 A1 * 12/2006 Pryor ..... E04C 3/005 52/645
2010/0251634 A1 * 10/2010 Diniz ..... E04H 12/10 52/121
2011/0185647 A1 * 8/2011 Diniz ..... E04H 9/16 52/111

* cited by examiner

VARIABLE HEIGHT TELESCOPING LATTICE TOWER

CROSS-REFERENCE TO RELATED APPLICATIONS

This application is a continuation of U.S. patent application Ser. No. 15/148,173, filed May 6, 2016, now U.S. Pat. No. 9,523,212, issued Dec. 20, 2016, which claims the benefit of U.S. patent application Ser. No. 14/675,242, filed Mar. 31, 2015, now U.S. Pat. No. 9,371,662, issued Jun. 21, 2016, the contents of which is incorporated herein by reference in their entirety.

BACKGROUND

Telescoping lattice towers are generally made up of multiple lattice sections that telescope within each other as shown in FIG. 1. The telescoping tower 10 depicted in FIG. 1 includes a base section 12 and two upper sections 14 and 16. Section 14 nests into base section 12 and section 16 nests into section 14.

The most common method used to extend and retract the sections 14 and 16 is by means of suspension cables made from wire rope. The base section 12 typically has a hand operated or motorized winch 18 to hoist the second lower most section 14 of the tower. All sections above the second lower most section 14 are cabled in a manner to respond to the movement of the second lower most section 14 relative to the base section 12 resulting in all sections telescoping simultaneously in both the extend and retract motions.

In the application of telescoping lattice towers with payloads having large projected wind sail areas, or if it is necessary to maintain stiffness in the extended tower, guy cables are often used. When an extended tower is equipped with guy cables, the result is larger vertical or axial loads from both the initial pre tensioning of the guy cables and resultant vertical loads from elevated wind speeds acting against the wind sail area(s).

When axial loads are increased, the loads in the lift or suspension cables also increase. In the case of the upper telescoping sections, multiple lift cables can be installed to increase the axial load capacity of the tower. However, this is not easily accomplished for the main lift cable or the winch cable.

In many applications, a lock system is incorporated at the interface of the base section and second lower most section to remove the main lift cable from the axial load path. The locks are typically located to lock the base section and second lower most section when the tower is at full extension.

FIG. 2 is a diagram showing a typical prior-art lock arrangement at the interface of the base section 12 and second lower most section 14 to remove the main lift cable from the axial load path. A lock base 20 includes opposed faces 24 each having a horizontal slot 26 and is fixed to each of the vertical members of the base section 12. A horizontally-oriented plate 28 is coupled to actuating arm 30 and is pivoted about pivot point 32.

To lock the second most lower section 14 to base section 12, the tower 10 is raised so that the bottom of the second most lower section 14 is positioned above slots 26 and the arm 30 is rotated to move the plate 28 through slots 26 in the opposing faces of the lock base 20 so that plate 28 is positioned under the bottom member 34 of the second most lower section 14. The tower 10 is then lowered until the bottom member 34 of the second most lower section 14 rests on plate 28, which then carries the vertical load of all of the upper sections of the tower 10 because it is captured in slots 26. FIG. 2 shows the lock plates 26 in the locked position.

While this solution addresses the problem when the tower is fully extended, there is a need for a system for locking the base section to the second lower most section at intermediate heights to allow the tower to be guyed at different elevations as opposed to only fully extended.

SUMMARY

The present invention is a system for locking the base section to the second lower most section provides for locking at incremental heights. Locking at incremental heights allows the main lift cable to be isolated from the axial load path enabling guying of the tower at incremental heights between its fully retracted height and its fully extended height.

According to one aspect of the present invention, a variable height telescoping tower includes a base section and a second lower most section nested within the base section and extendable from within the base section. The second lower most section includes a plurality of vertically spaced lock apertures disposed thereon. A lock member is attached to the base section, and includes an engaging portion movable between a disengaged position at which the engaging portion rests outside of the lock apertures and an engaged position at which the engaging portion is engaged within one of the lock apertures of the second lower most section.

According to another aspect of the present invention, the second lower most tower section includes a lattice plate member in place of the round bar stock lattice members normally used to secure the tower section legs together.

DRAWINGS

These and other features, aspects and advantages of the present invention will become better understood with regard to the following description, appended claims, and accompanying drawings where:

DESCRIPTION

Persons of ordinary skill in the art will realize that the following description of the present invention is illustrative only and not in any way limiting. Other embodiments of the invention will readily suggest themselves to such skilled persons.

According to one embodiment of the present invention, the design of lattice structure used on the second lower most tower section in the area that overlaps the base tower section when the tower is completely retracted is provided with multiple lock apertures at different heights to allow engagement of a lock mechanism. Typical lattice members are made from shapes such as round bar, tubing or structural shapes. In the present invention, the typical type lattice structure is replaced with a lattice structure having lock apertures to allow engagement of a lock mechanism at frequent intervals. This can be accomplished in a number of ways. The variable height telescoping tower of the present invention may be fabricated from steel, although persons of ordinary skill in the art will appreciate that other materials may be employed. Persons of ordinary skill in the art will observe that, while the embodiments of the invention disclosed herein are described with reference to a triangular tower, the principles of the present invention equally apply to other tower configurations, such as but not limited to towers having a square cross section.

Figure 1:
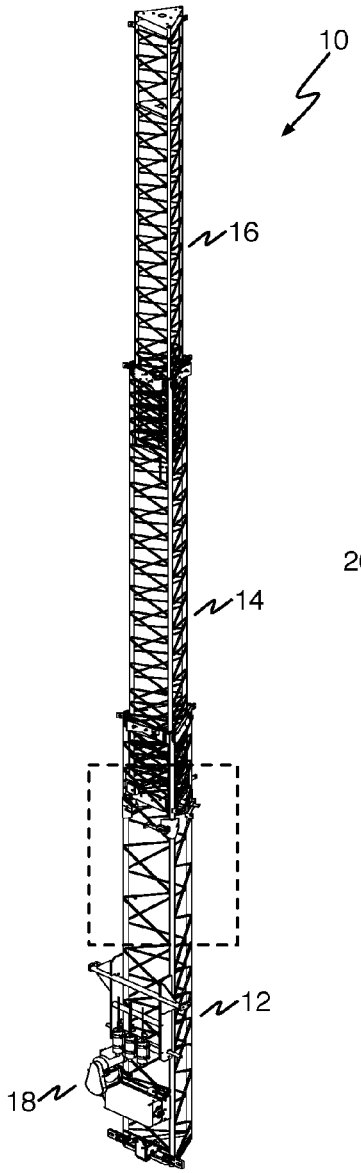
FIG. 1 (PRIOR ART)
FIG. 1 is a drawing depicting a typical prior-art telescoping tower.
Figure 2:
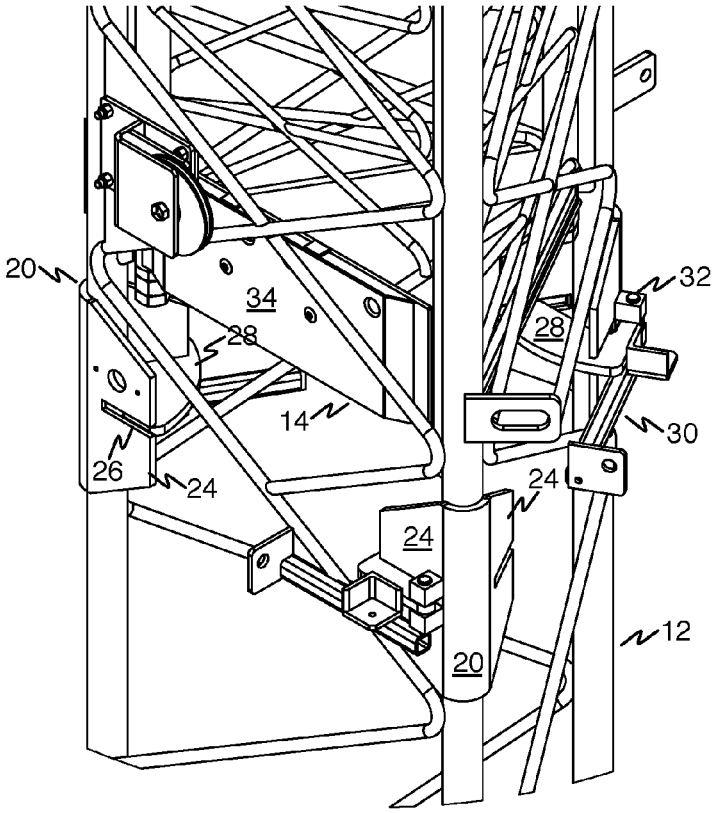
FIG. 2 (PRIOR ART)
FIG. 2 is a drawing depicting a lock system incorporated at the interface of the base section and second lower most section to remove the main lift cable from the axial load path when the tower is fully extended.
Figure 3:
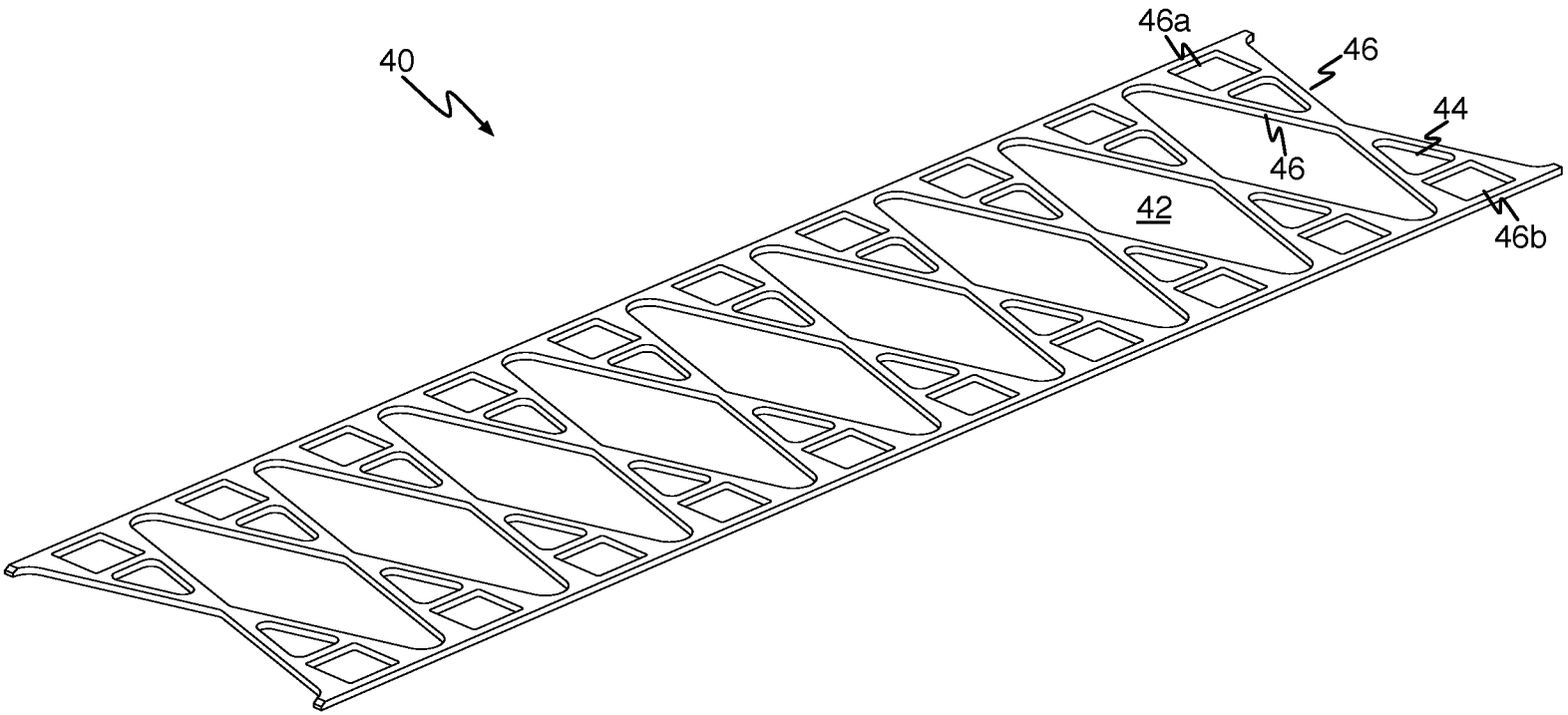
FIG. 3 is diagram depicting an illustrative lattice structure design for the second lower most tower section having multiple lock apertures to allow engagement of a lock mechanism at frequent intervals.

Referring now to FIG. 3, a diagram depicts an illustrative lattice structure design for the second lower most tower section having multiple lock apertures to allow engagement of a lock mechanism at frequent intervals. Lattice plate 40 is preferably formed from a steel sheet. In one particular embodiment, Lattice plate 40 may be formed from half-inch thick steel plate.

As may be seen from an examination of FIG. 3, lattice plate 40 may be perforated to decrease the weight of the second lower most tower section using a pattern selected to maintain its structural integrity. In the particular embodiment shown in FIG. 3, lattice plate 40 is provided with a series of first apertures, shown in FIG. 3 as rhombic-shaped apertures (one of which is identified by reference numeral 42), formed along its length. Smaller triangular apertures (one of which is identified by reference numeral 44) are also formed in lattice plate 40. Apertures 42 and 44 may be referred to herein as "cross bracing voids" and may be formed by processes such as stamping, flame cutting, plasma cutting, laser cutting or the like.

According to an illustrative embodiment of the present invention, apertures 42 and 44 are arranged in a pattern that results in the remaining steel structure of plate 40 (some of which are identified by reference numerals 46) resembling the cross bracing rods found in conventional lattice tower structures. As noted, the particular pattern of apertures need not be as shown in FIG. 3, but should be designed to provide structural integrity to lattice plate 40 considering the mechanical forces to which it will be subjected in use.

Lattice plate 40 also includes a plurality of spaced apart rectangular lock apertures formed along each of its opposing long sides. In one embodiment of the invention, pairs of lock apertures on opposing long sides of lattice plate 40 are in alignment with one another. One such pair of lock apertures is designated by reference numerals 46*a* and 46*b*. In one embodiment of the present invention, pairs of lock apertures are separated vertically by a uniform distance as shown in FIG. 3. In other embodiments of the invention, pairs of lock apertures may be separated vertically by non-uniform distances.

In one embodiment of the present invention, the lattice plate 40 may be formed as a single piece. In other embodiments of the present invention, the lattice plate 40 may have a shorter length and two or more lattice plates 40 may be placed end to end to form a combined lattice plate having a longer length.

Figure 4:
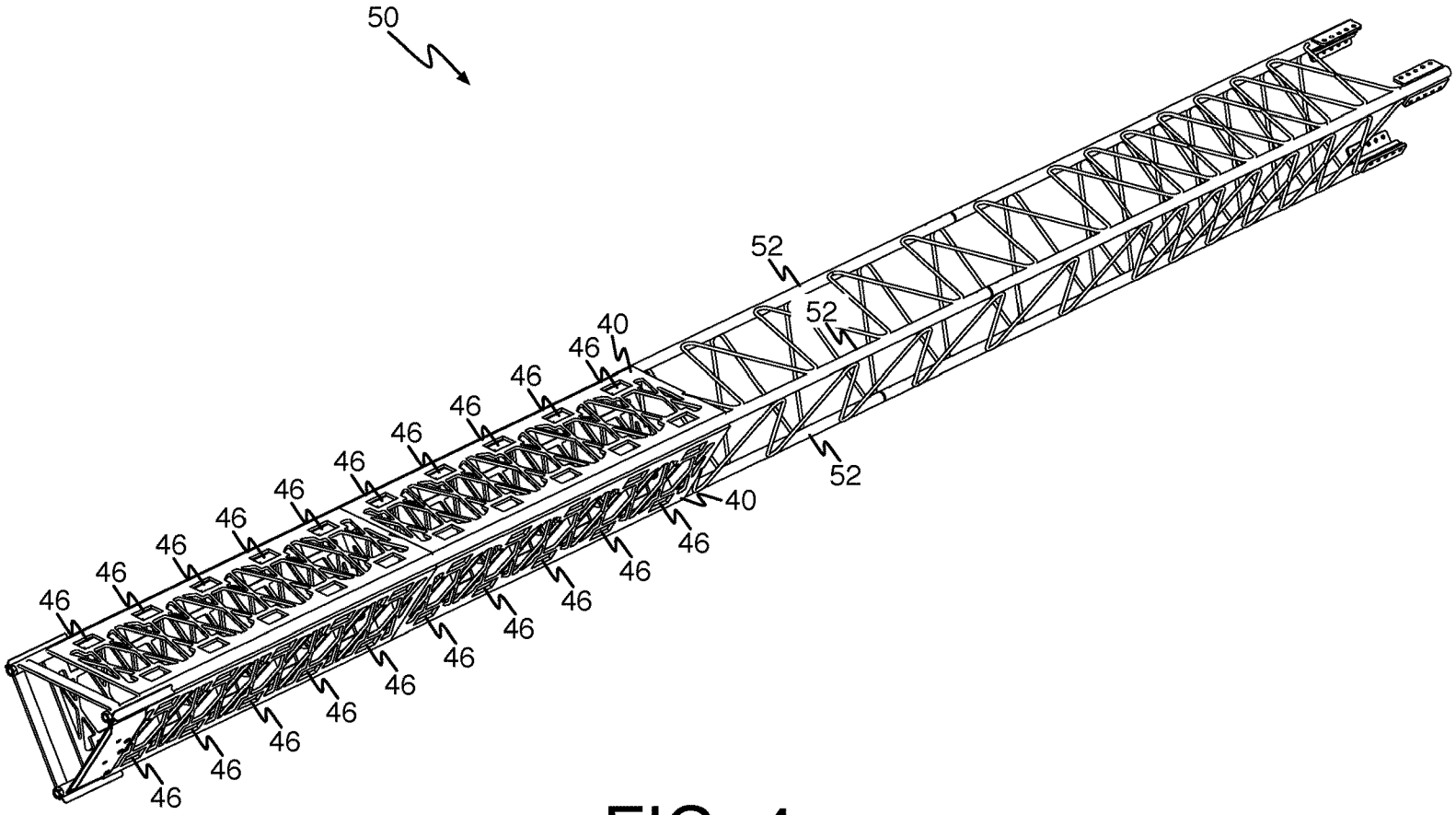
FIG. 4 is a diagram depicting an illustrative second lower most tower section incorporating the lattice structure design of FIG. 3.

Referring now to FIG. 4, a diagram depicts an illustrative second lower most tower section 50 in accordance with the principles of the present invention. In general, the second lower most tower section 50 includes a plurality of lock apertures 46 on each of its faces. These apertures will engage lock mechanisms to lock the second lower most tower section to the base tower section at various heights as disclosed herein.

The embodiment shown in FIG. 4 incorporates the lattice plate 40 design of FIG. 3 to provide the plurality of lock apertures 46 to allow engagement of a lock mechanism at frequent intervals. In the particular embodiment illustrated in FIG. 3, a lattice plate 40 having lock apertures 46 formed into it is fastened to each leg 52 of the tower, such as by welding to the tubular vertical leg members 52 of the second lower most tower section 50. Persons of ordinary skill in the art will appreciate that arrangements other than providing a windowed plate may be used to provide lock apertures 46 at different vertical positions along the height of the second lower most tower section 50. It will be apparent, though that use of a lattice plate 40 simplifies manufacturing costs due to the ease of fabrication.

Figure 5:
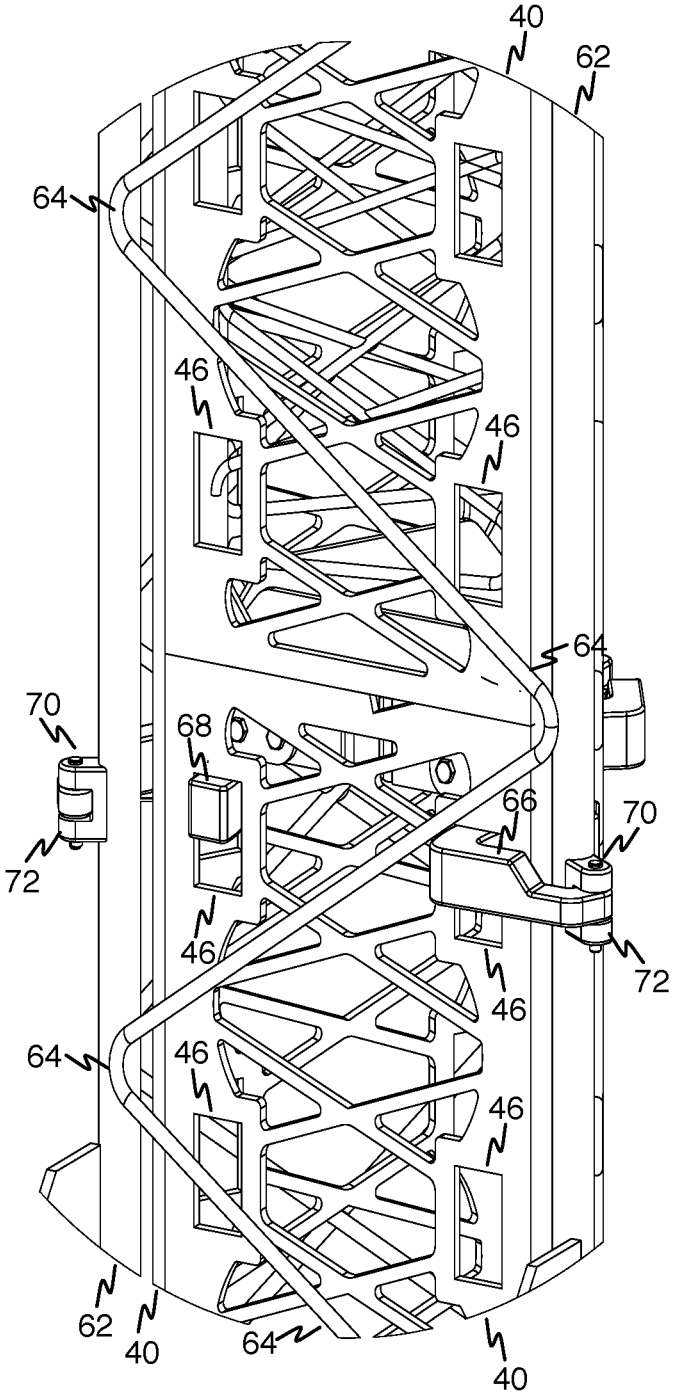
FIG. 5 is a diagram depicting a portion of the base section and second lower most section of a telescoping tower showing an illustrative design for locking the base section to the second lower most section at incremental heights.

The second lower most section includes vertical tubular members 52 (two of the three are shown) held together in a spaced apart relationship along a portion of the length of the second lower most section 50 by lattice plates 40 to which they are welded as has been shown in FIG. 4. While FIG. 5 shows two plates 40, persons of ordinary skill in the art will appreciate that a single plate 40 may be employed. Each of plates 40 include multiple lock apertures 46 vertically separated from one another.

The tubular members 52 along the remainder of the length of second lower most section 50 are held together in a spaced apart relationship by at least one lattice bar 54 which zig zags between or otherwise spans the distance between tubular members 52. The at least one lattice bar is welded to tubular members 52 as is known in the art.

In the embodiment of the second lower most tower section 50 depicted in FIG. 4, the lattice plate 40 extends less than half of the length of the second lower most tower section 50 from slightly above the bottom 54 of second lower most tower section 50. This is because the operation of the particular illustrative embodiment of the lock mechanism depicted herein requires that the interior space within the second lower most tower section 50 be clear of the other tower sections nested with in the second lower most tower section 50. In other embodiments of the invention the operation of the lock mechanism does not require that the interior space within the second lower most tower section 50 be clear of the other tower sections nested with in the second lower most tower section 50.

Referring now to FIG. 5, a diagram depicts a portion of a base section 60 and second lower most section 50 of a telescoping tower showing an illustrative design for a lock mechanism used for locking the base section 60 to the second lower most section 50 at incremental heights. The base section 60 is formed from vertical tubular members 62 (two of the three are shown) held together in a spaced apart relationship by at least one lattice bar 64, formed, for example of round steel bar stock, which zig zags between or otherwise spans the distance between tubular members 62. The at least one lattice bar is welded to tubular members 62 as is known in the art.

A plurality of lock mechanisms each include a lock arm 66 having an end 68. Each lock arm 66 is pivotally mounted on a lock arm mount 70 one of the vertical tubular members 62 of the base section at pivot 72 such that the end 68 engages the lock aperture 46 when the lock arm 66 is pivoted into the lock position and disengages the lock aperture 46 when the lock arm 66 is pivoted into the unlock position to allow the second lower most section to be raised or lowered. FIG. 5 shows the second lower most section 50 locked to the base section 60 as the end 68 can be seen engaged in the lock aperture 46 on the left side of FIG. 5. Persons of ordinary skill in the art will appreciate that a support surface (not shown in FIG. 5) may be provided under each of lock arms 66 to carry the vertical load and prevent the weight of the second lower most tower section from exerting a torque on the pivot 72 of each lock arm 66.

As may be seen from an examination of FIG. 5, the vertical dimensions of lock apertures 46 is larger than the vertical dimension of the ends of lock arms 66. In use, the tower is raised to vertically align the lock apertures 46 with the lock arms 66, and then the lock arms 66 are rotated into the lock apertures 46 to place the lock mechanisms in the locked position. Once this is done, the tower is lowered until the tops of the lock apertures 46 rest on the top surfaces of the lock arms 66. To disengage the locks, the tower is raised slightly to disengage the top surfaces of the lock arms 66 from the tops of the lock apertures 46. The lock arms 66 are then rotated out of the lock apertures 46 to place the lock mechanisms in the unlocked position.

Figure 6B:
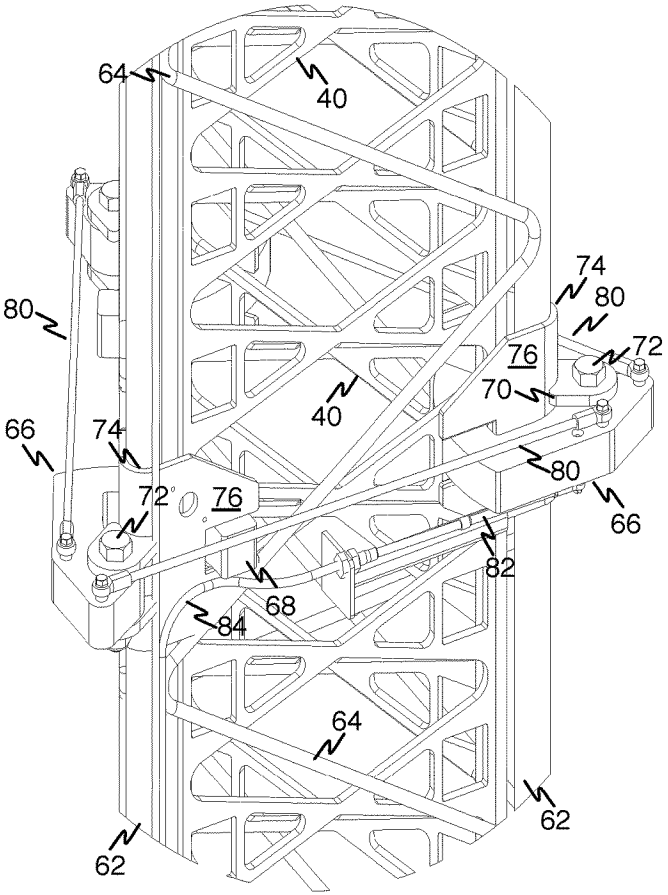
FIG. 6A and FIG. 6B are diagrams showing an illustrative locking mechanism in accordance with the present invention in an unlocked position and a locked position, respectively.
Figure 6A:
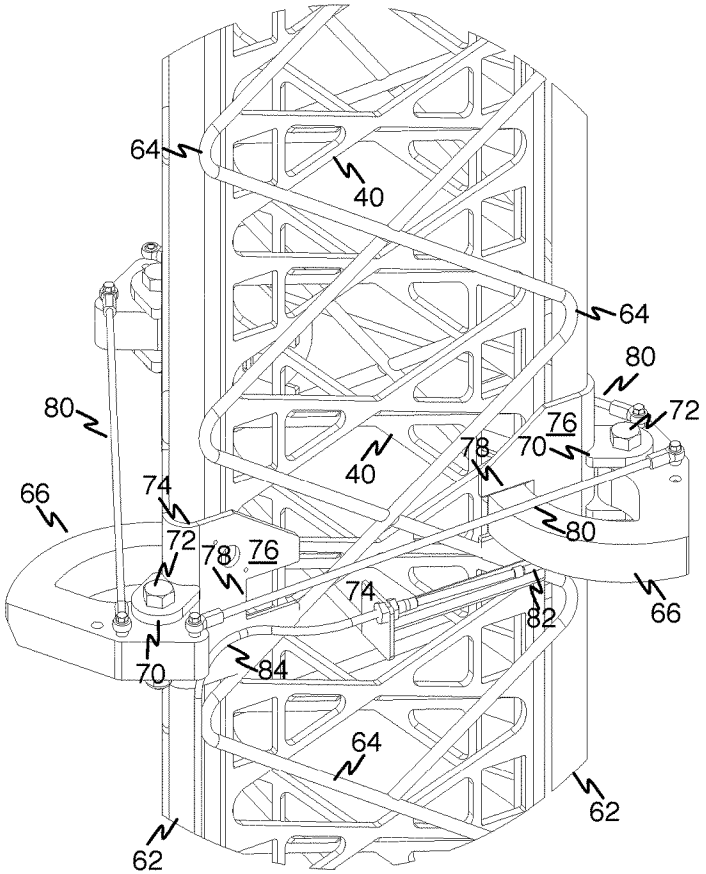
Figure 7B:
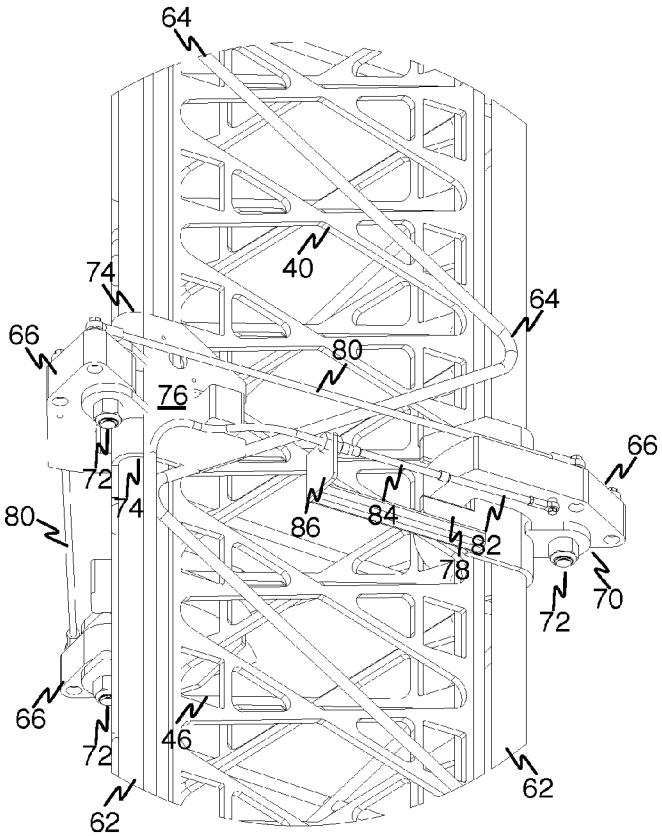
FIG. 7A and FIG. 7B are diagrams showing another view of the illustrative locking mechanism of FIGS. 6A and 6B in the unlocked position and the locked position, respectively.
Figure 7A:
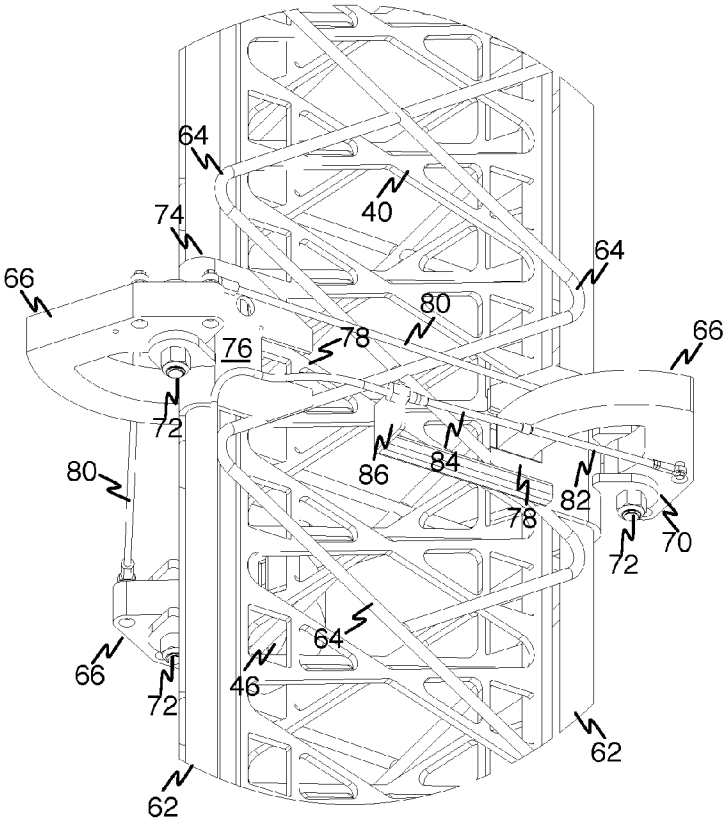
Figure 8A:
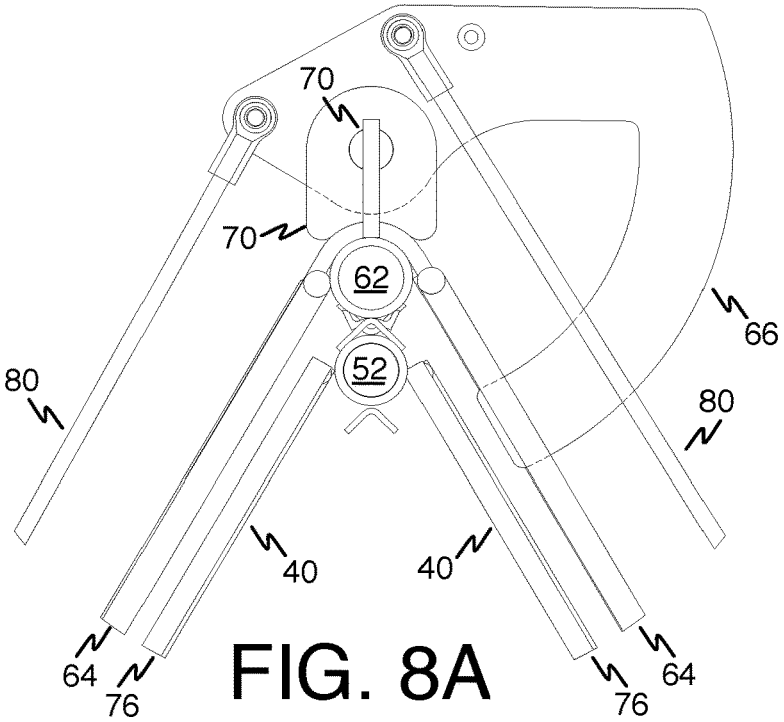
FIGS. 8A and 8B are diagrams showing a cross sectional view of one of the illustrative locking mechanism of FIGS. 6A and 6B in the unlocked position and the locked position, respectively.
Figure 8B:
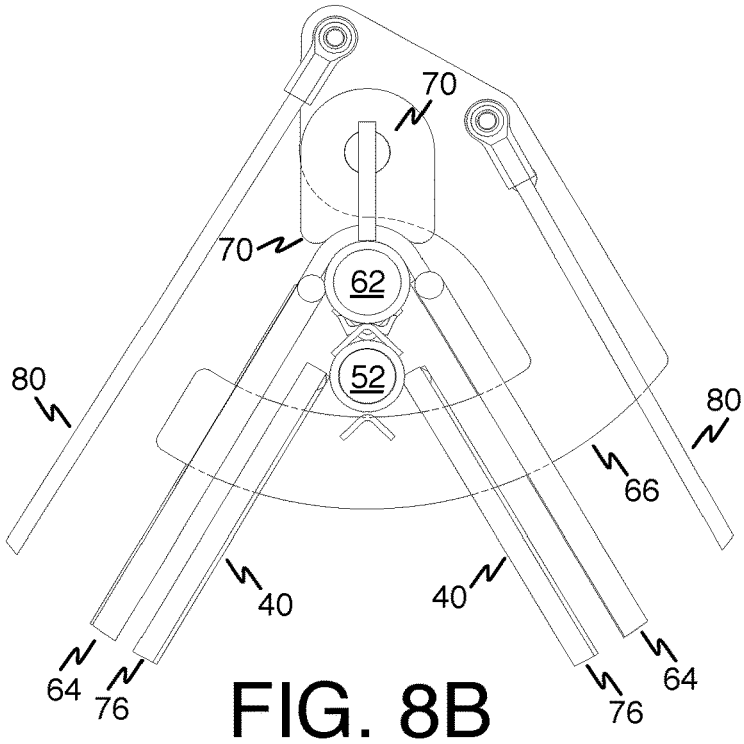
Figure 9A:
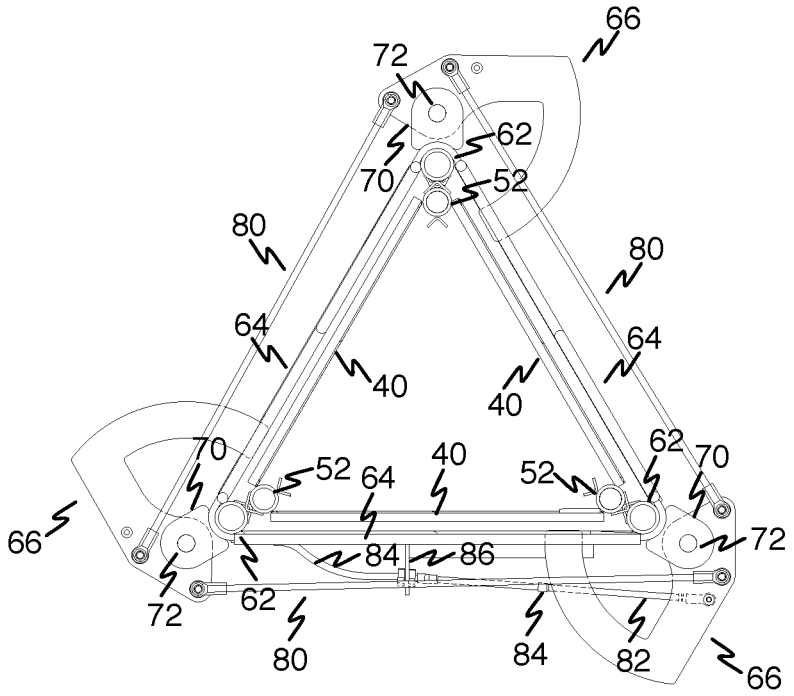
FIGS. 9A and 9B are diagrams showing a top view of the locking mechanisms of FIGS. 6A and 6B in the unlocked position and the locked position, respectively.
Figure 9B:
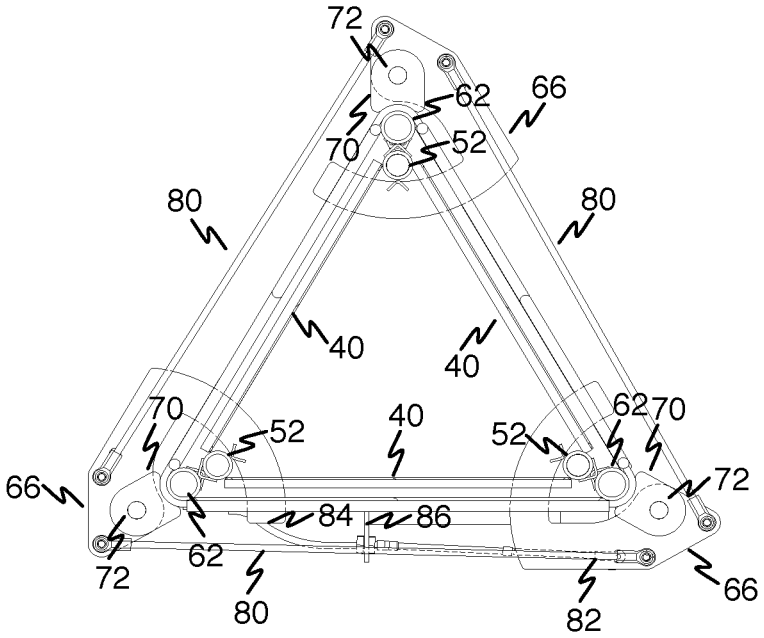

Referring now to FIGS. 6A, 6B, 7A, 7B, 8A, 8B, 9A and 9B a series of diagrams show several different views of an illustrative locking mechanism in both an unlocked position and a locked position, respectively. FIGS. 6A and 6B each show an upper isometric view of the locking mechanism. FIGS. 7A and 7B each show a lower isometric view of the locking mechanisms. FIGS. 8A and 8B each show a cross sectional view of one of the illustrative locking mechanism of FIGS. 6A and 6B. Finally, FIGS. 9A and 9B each show a top view of the locking mechanisms. FIGS. 6A, 7A, 8A, and 9A show the locking mechanism in the unlocked position and FIGS. 6B, 7B, 8B, and 9B show the locking mechanism in the locked position.

All of FIGS. 6A, 6B, 7A and 7B show the second lower most tower section 50 formed from tubular members 52 and lattice plates 40 partially nested within the lower most tower section 60 formed from tubular members 62 and lattice rod 64. A plurality of lock mechanisms each including a lock arm 66 having a tab 68 extending from an end thereof. Each lock arm 66 is shown mounted on a lock mount 70 on one of the vertical tubular members 62 of the base section at pivot 72. In the embodiment shown in FIGS. 6A, 6B, 7A and 7B, the lock mount 70 for each lock arm 66 is mounted to a mounting plate 74 attached (for example by welding) to each of the tubular members 62 and having opposing faces 76. Each opposing face 76 of each mounting plate 74 has a notch 78 formed therein.

The lock arms are actuated by actuator rods 80. Each actuator rod 80 extends across one face of the tower and is connected between adjacent ones of the lock arms 66. By using three actuator rods 80 as a mechanical linkage to connect together all of the lock arms 66, the rods can operate in tension no matter whether the lock arms 66 are being moved to engage or to disengage the lock mechanisms.

In the embodiment of the present invention depicted herein, the lock arms are moved by a sheathed push/pull control cable 82 to engage and to disengage the lock mechanisms. Sheathed push/pull control cable mechanisms are well known in the art. A first end of cable 82 is fastened to one of the lock arms 66. A first end of the sheath 84 surrounding cable 82 is anchored at support 86 to the one of the mounting plates 78 to which the cabled lock arm is mounted. A second end of the sheath 84 is preferably mounted towards the lower end of lower most tower section 62 and the second end of cable 82 is coupled to a lever to move the cable 82 from a first position where it extends out of sheath 84 and the lock mechanism is disengaged to a second position where it is pulled into the sheath 84 to pivot the lock arm 66 and engage the lock mechanism.

While the embodiments disclosed herein employ a sheathed push/pull control cable 82 to engage and to disengage the lock mechanisms, the present invention is not limited to lock mechanisms driven by sheathed push/pull control cable arrangements. Persons of ordinary skill in the art will appreciate that other drive mechanisms, such as but not limited to solenoids, motor-driven screw drives, etc. may be used to engage and to disengage the lock mechanisms.

When in the locked position as shown in FIG. 6B, the lock arm passes through the slot 78 on one face 76 of mounting plate 72, through a lock aperture on a lattice plate 40 on a first face of the second lower most tower section 50, around the inside of the second lower most tower section 50, through a lock aperture on a lattice plate 40 on a second face of the second lower most tower section 50 adjacent to the first face, and through the slot 78 on the face 76 of mounting plate 72. As most easily seen in FIG. 7B, the bottom surfaces of the slots 78 provide structural support for the lock arms to bear the downward forces exerted by the second lower most tower section 50 when the lock is in the locked position.

As with the embodiment depicted in FIG. 5, in the embodiments shown in FIGS. 6A, 6B, 7A, 7B, 8A, 8B, 9A and 9B, the vertical dimensions of lock apertures 46 is larger than the vertical dimension of the ends of lock arms 66. In use, the tower is raised to vertically align the lock apertures 46 with the lock arms 66, and then the lock arms 66 are rotated into the lock apertures 46 to place the lock mechanisms in the locked position. Once this is done, the tower is lowered until the tops of the lock apertures 46 rest on the top surfaces of the lock arms 66. To disengage the locks, the tower is raised slightly to disengage the top surfaces of the lock arms 66 from the tops of the lock apertures 46. The lock arms 66 are then rotated out of the lock apertures 46 to place the lock mechanisms in the unlocked position.

Figure 10:
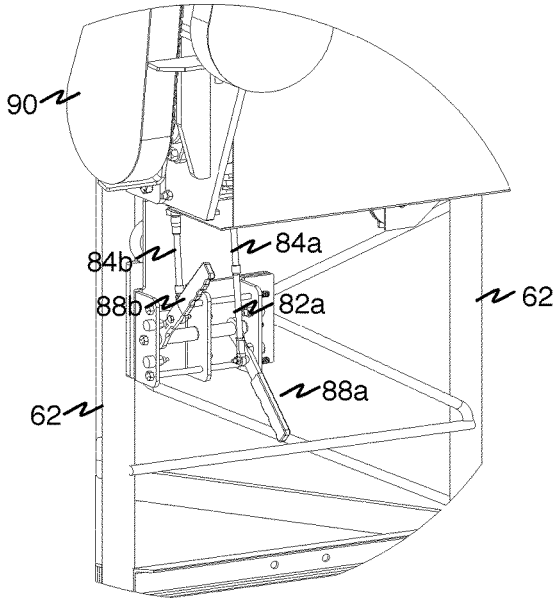
FIG. 10 is a diagram showing a tower including two groups of illustrative lock mechanisms disposed at different heights.

Referring now to FIG. 10, a diagram shows an exemplary engagement mechanism including levers 88*a* and 88*b*, each one controlling a group of three lock mechanisms as shown in FIGS. 6A, 6B, 7A, 7B, 9A and 9B. The lever 88*a* is shown in the locked position where the lever 88*a* has pulled cable 82*a* downward through the sheath 84*a* to move the group of locking mechanisms with which it is associated to the locked position. The lever 88*b* is shown in the locked position where its cable (not shown) has been pushed upward through the sheath 84*b* to move the group of locking mechanisms with which it is associated to the unlocked position. A portion of a motor drive unit 90 for raising and lowering the tower is shown in FIG. 10.

Figure 11:
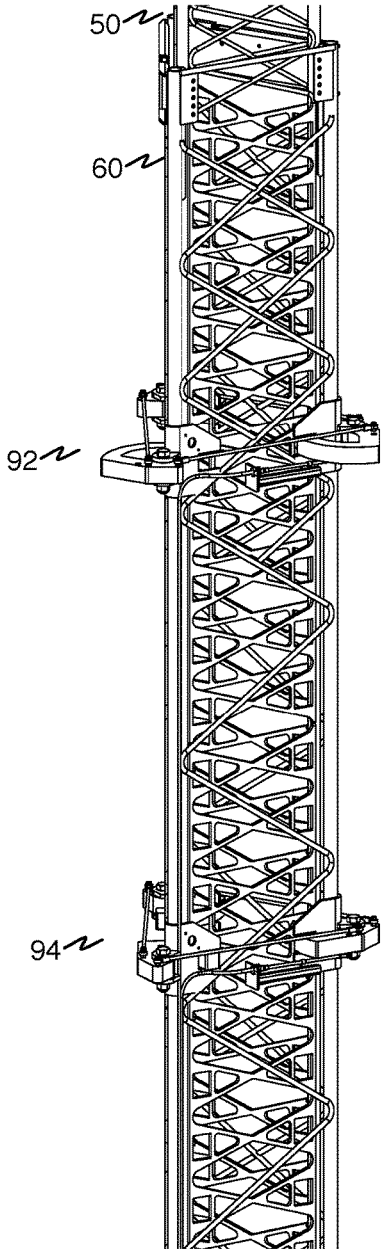
FIG. 11 is a diagram depicting a variable height telescoping tower including two sets of lock mechanisms disposed at different heights on the base section.

Referring now to FIG. 11, a diagram depicts a second lower most tower section 50 partially nested inside a base tower section 60. Two sets of lock mechanisms 92 and 94 are shown disposed at different heights on the base section 60. The two sets of lock mechanisms 92 and 94 can be used individually to provide a wider range of positions at which second lower most tower section 50 can be locked to base tower section 60 or together to provide greater support strength.

Although the present invention has been discussed in considerable detail with reference to certain preferred embodiments, it would be apparent to those skilled in the art that many more modifications than mentioned above are possible without departing from the inventive concepts herein. Therefore, the scope of the appended claims should not be limited to the description of preferred embodiments contained in this disclosure.

What is claimed is:

1. A lattice plate for a section of a multi-section variable-height telescoping tower, the lattice plate comprising:

a flat elongate plate disposed in a plane;

a plurality of first cross bracing voids formed in the elongate plate along a lengthwise central axis of the elongate plate, the plurality of first cross bracing voids spaced apart from one another and extending substantially the entire width of the elongate plate;

a plurality of second cross bracing voids formed in pairs in the elongate plate, each pair of the second cross bracing voids disposed symmetrically about the lengthwise central axis of the elongate plate on an axis perpendicular to the lengthwise central axis and alternating in vertical positions with the first cross bracing voids, the second cross bracing voids having areas smaller than areas of the first cross bracing voids and having geometries different from geometries of the first cross bracing voids, regions of the elongate plate lying between the first cross bracing voids and the second cross bracing voids forming cross bracing members in the elongate plate;

at least one set of lock aperture voids formed in the elongate, plate along a lock aperture axis, the lock aperture axis oriented parallel to the central axis of the elongate plate and positioned proximate to a side edge of the elongate plate, the lock aperture voids having areas smaller than the areas of the first cross bracing voids and having geometries different from geometries of the second cross bracing voids and being disposed at vertical positions between ones of the first cross bracing voids and being configured to receive a movable lock member when the lock member is in an engaged position.

2. The lattice plate of claim 1 wherein the at least one set of lock aperture voids comprises:

a first set of lock aperture voids formed in the elongate plate along a first lock aperture axis, the first lock aperture axis oriented parallel to the central axis of the elongate plate and positioned proximate to a first side edge of the elongate plate; and a second set of lock aperture voids formed in the elongate plate along a second lock aperture axis, the second lock aperture axis oriented parallel to the central axis of the elongate plate and positioned proximate to a second side edge of the elongate plate opposite the first side edge.

3. The lattice plate of claim 1 wherein the plurality of first cross bracing voids and the plurality of second cross bracing voids are shaped and oriented such that two intersecting diagonal cross bracing members are formed from regions of elongate plate material remaining between adjacent ones of the first and second cross bracing voids.

4. The lattice plate of claim 2 wherein the plurality of first cross bracing voids are shaped and oriented such that two intersecting diagonal cross bracing members are formed from regions of elongate plate material remaining between adjacent ones of the first and second cross bracing voids.

5. A tower section nestable within and lockable to an adjacent tower section and comprising:

first, second, and third vertical leg members, adjacent pairs of the first, second, and third vertical leg members attached to one another along a first portion of their lengths by a lattice plate, each lattice plate having a first end and a second end, and along a second portion of their lengths by at least one diagonal bracing bar, the first ends of the lattice plates positioned proximate to bottom ends of the first, second, and third vertical leg members, the at least one diagonal bracing bars each extending from a position proximate to the second end of one of the lattice plates to a position proximate to top ends of the first and second vertical leg members;

the first, second, and third, lattice plates each having first and second opposing side edges and including:

a first plurality of cross bracing voids formed therein along a lengthwise central axis, the plurality of cross bracing voids spaced apart from one another and extending substantially the entire width thereof;

at least one set of lock aperture voids formed therein along a lock aperture axis, the lock aperture axis oriented parallel to the central axis and positioned proximate to a side edge thereof, the lock aperture voids having an area smaller than an area of the cross bracing voids and being configured to receive a movable lock member when the lock member is in an engaged position.

6. The tower section of claim 5 wherein the at least one set of vertically aligned lock aperture voids comprise:

a first set of lock aperture voids formed along a first lock aperture axis, the first lock aperture axis oriented parallel to the central axis and positioned proximate to a first side edge; and a second set of lock aperture voids formed along a second lock aperture axis, the second lock aperture axis oriented parallel to the central axis and positioned proximate to a second side edge opposite the first side edge, corresponding lock apertures of the first, second, and third, lattice plates positioned in horizontal alignment with one another.

7. The tower section of claim 5 wherein:

corresponding bottom lock apertures of the first second and third lattice plates are positioned to lock the tower section at a fully extended position.

8. The tower section of claim 7 wherein:

corresponding top lock apertures of the first, second, and third lattice plates are positioned to lock the tower section at a vertical position where additional telescoping tower sections nested within the tower section have cleared an interior space defined by the first, second, and third vertical leg members and the first, second, and third lattice plates.

9. The tower section of claim 6 wherein:

pairs of corresponding lock apertures of adjacent ones of the lattice plates closest to one of the first, second, and third vertical legs are disposed in a path traversed by a lock member mounted on an enclosing tower section in which the tower section is nested;

corresponding bottom lock apertures of the first, second, and third lattice plates are positioned to lock the tower section at a fully extended position; and corresponding top lock apertures of the first, second, and third lattice plates are positioned to lock the tower section at a partially extended position where additional telescoping tower sections nested within the tower section have cleared an interior space defined by the first, second, and third vertical leg members and the first, second, and third lattice plates.

10. The tower section of claim 5 wherein the lattice plates and the at least one diagonal bracing bars are attached to the vertical leg members by welding.

* * * * *